US007003253B2

(12) United States Patent
Uchida et al.

(10) Patent No.: US 7,003,253 B2
(45) Date of Patent: Feb. 21, 2006

(54) IMAGE HEATING APPARATUS INCLUDING ROTARY MEMBER WITH METAL LAYER

(75) Inventors: Michio Uchida, Shizuoka (JP); Masao Umezawa, Shizuoka (JP); Atsutoshi Ando, Kanagawa (JP); Toshikazu Tsuchiya, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 167 days.

(21) Appl. No.: 10/691,497

(22) Filed: Oct. 24, 2003

(65) Prior Publication Data

US 2004/0081491 A1 Apr. 29, 2004

(30) Foreign Application Priority Data

Oct. 28, 2002 (JP) ..... 2002-312872

(51) Int. Cl.
*G03G 15/20* (2006.01)

(52) U.S. Cl. ..... 399/328; 399/329

(58) Field of Classification Search ..... 399/328, 399/329, 333; 219/216
See application file for complete search history.

(56) References Cited

U.S. PATENT DOCUMENTS

| | | | | |
|---|---|---|---|---|
| 6,347,201 | B1 | 2/2002 | Sano et al. | 399/67 |
| 6,385,428 | B1 | 5/2002 | Uchida et al. | 399/303 |
| 6,430,386 | B1 | 8/2002 | Okubo et al. | 399/328 |
| 6,438,349 | B1 | 8/2002 | Ando | 399/333 |
| 6,518,546 | B1 * | 2/2003 | Otsuka et al. | 219/216 |
| 6,671,489 | B1 * | 12/2003 | Natsuhara et al. | 399/329 |
| 6,748,192 | B1 * | 6/2004 | Izawa et al. | 399/329 |
| 6,787,737 | B1 * | 9/2004 | Uekawa et al. | 219/216 |

* cited by examiner

*Primary Examiner*—William J. Royer
(74) *Attorney, Agent, or Firm*—Fitzpatrick, Cella, Harper & Scinto

(57) ABSTRACT

An image heating apparatus for heating an image formed on a recording material, including a heater, a holder for holding the heater, a rotating member rotating around the holder and being flexible and having a metal layer, and a pressure roller forming a nip with the heater across the rotating member, wherein the rotating member moves detaching from the pressure roller just after passing through a downstream end portion of a surface of the heater opposed to the pressure roller. Thus, an uneven heating of a toner image can be prevented even in a case where the recording material becomes undulated after passing the nip portion.

2 Claims, 6 Drawing Sheets

FIG. 3

| SEPARATION ANGLE $\alpha$ | TRANSPARENCY/ UNEVEN GLOSSY | SEPARATABILITY | ENDURANCE |
|---|---|---|---|
| -15° | × | ○ | × |
| -10° | × | ○ | △ |
| -5° | △ | △ | ○ |
| 0° | △ | × | ○ |
| 5° | ○ | △ | ○ |
| 10～40° | ○ | ○ | ○ |
| 45° | ○ | ○ | △ |
| 50° | ○ | ○ | × |

IMAGE HEATING APPARATUS INCLUDING ROTARY MEMBER WITH METAL LAYER

BACKGROUND OF THE INVENTION

1. Field of the Invention

The present invention relates to an image heating apparatus for heating an image on a recording material, and more particularly to an image heating apparatus adapted for use as a heat fixation device to be employed in a copying machine or a printer.

2. Related Background Art

As a fixing apparatus to be mounted in an image forming apparatus such as a copying apparatus, there has been employed a heat roller system as shown in FIG. 4. Such system has a basic configuration including a heating roller 102 for example of a metal, provided therein with a heater 101, and an elastic pressure roller 103 maintained in pressed contact therewith, and introducing and passing a recording medium, constituting a member to be heated, in a nip portion of such paired rollers for conveying therethrough, thereby fixing a toner image under heating and a pressure.

However, the fixing apparatus of such heat roller system has required a very long time for elevating the roller surface to a fixing temperature because of a large heat capacity of the roller. Therefore, in order to achieve a prompt image outputting operation, it is necessary to control the roller surface at a certain temperature even when the apparatus is not in use.

For this reason, there has been proposed a heating apparatus of a fixing film heating type, in which a film heated by a heater is utilized for fixing a developer to a recording medium. The fixing apparatus of such fixing film heating type is constituted, as shown in FIG. 5, usually of a fixing film 114 a thin heat-resistant resin (for example polyimide), a heater 113 fixedly positioned at a side of the fixing film 114, a heater holder 112 for holding the heater 113 in contact with the fixing film 114, a reinforcing stay 111 for reinforcing the heater holder 112, and a pressure roller 115 for maintaining a recording medium, constituting a member to be heated, in contact with the heater 113 across the fixing film 114.

In case it is used as a fixing apparatus, a recording medium bearing a toner image is introduced in and passed through a contact nip portion formed by a contact of the heater 113 and the pressure roller 115 across the fixing film 114, whereby an image bearing surface of the recording medium is heated by the heater 113 across the fixing film 114 to provide the unfixed image with thermal energy thereby softening and fusing the toner and fixing the image by heat.

In the fixing apparatus of such fixing film heating type, a heater of a low heat capacity can be employed because the fixing film 114 has a low heat capacity. For this reason, it is possible to reduce an electric power consumption and to shorten a waiting time to a fixable state, in comparison with apparatus of a heat roller type or a belt heating type.

In case of using the fixing film 114, it is in a slack state in a downstream side of the nip, so that it tends to follow a conveying direction of the recording medium in contact therewith. If the fixing film 114 remains in contact with the recording medium, a curvature at a separating portion decreases, thereby tending to cause a sticking jam to the fixing film 114.

In order to avoid such trouble, it is necessary, in the heat fixing apparatus of the film heating type, to facilitate the separation of the fixing film 114 and the recording medium at a downstream side of the pressed nip in the conveying direction of the recording medium. For this purpose, as shown in FIG. 5, a separating projection 112*a* may be provided on the heater holder 112 at a downstream end of the heater 113. In the heat fixing apparatus of the film heating type, the curvature at the separating portion is made larger in order to prevent the sticking jam. In such configuration, the fixing film 114 and the recording medium remain in close contact over a long range without pressure even after passing the nip where the pressure roller 115 is in contact, as shown in FIG. 5. However, there results a following drawback. In a portion immediately after a recording medium S is discharged from the nip of the fixing film 114 and the pressure roller 115, as shown in FIGS. 6 and 7, the recording medium S shows a thermal expansion simultaneous with the release of the recording medium S from the constriction in the nip, and an undulation Sa in the longitudinal direction appears in the recording medium S because of a difference in the expansion rate between a portion constricted in the nip and a released portion after the nip. In such undulated state, a convex portion of the recording medium S contact longer, than a concave portion, with the fixing film 114. As a result, a convex portion of the recording medium S tends to receive an excessive heat in comparison with a concave portion, as shown in FIG. 7. Such undulation Sa is more noticeable in a recording medium S of a resinous film such as an OHP sheet or a glossy film, but also appears in plain paper or glossy paper.

In case the fixing film 114 is constituted for example of a polyimide film with a very small heat capacity (for example a thickness of 50 $\mu$m and a heat capacity per unit area of 0.01 $J/cm^2 \cdot K$), a difference in the amounts of heat received by such convex portion and concave portion is small and does not exert a significant influence on the image.

However, in case of employing a fixing sleeve constituted of an elastic layer, a releasing layer and a metal film, having a certain heat capacity (for example a heat capacity per unit area of 0.1 $J/cm^2 \cdot K$), a convex portion in an undulation Sa generated in the recording medium S receives excessive heat in comparison with a concave portion. Such excessive heat deteriorates a surface smoothness of the recording medium S in a convex portion thereof, thereby deteriorating a transparency along the convex portion of the undulation Sa as shown in FIG. 8 in case the recording medium S is an OHP sheet, or generating an unevenness in the glossiness in case the recording medium S is a glossy film. Also in an ordinary recording paper, a thermal offset is generated in the convex portion.

SUMMARY OF THE INVENTION

The present invention has been made in consideration of the foregoing, and an object of the present invention is to provide an image heating apparatus capable of suppressing an uneven heating of a toner image even in case a recording medium after passing a nip portion generates an undulation.

Another object of the present invention is to provide an image heating apparatus for heating an image formed on a recording medium, including:

a heater;

a holder for holding the heater;

a rotating member rotating around the holder, the rotating member being flexible and having a metal layer; and a pressure roller forming a nip with the heater across the rotating member;

wherein the rotating member moves in a direction and is detached from the pressure roller just after passing through a downstream end portion of a surface of the heater at a side of said pressure roller in surfaces of said heater.

Still other objects of the present invention will become fully apparent from the following detailed explanation which is to be taken in conjunction with the accompanying drawings.

BRIEF DESCRIPTION OF THE DRAWINGS

FIG. 3 is a table showing experimental results of an optical transparency, a separability for the recording medium and an endurance of the fixing film as a function of a separation angle $\alpha$;

DESCRIPTION OF THE PREFERRED EMBODIMENTS

Figure 1:
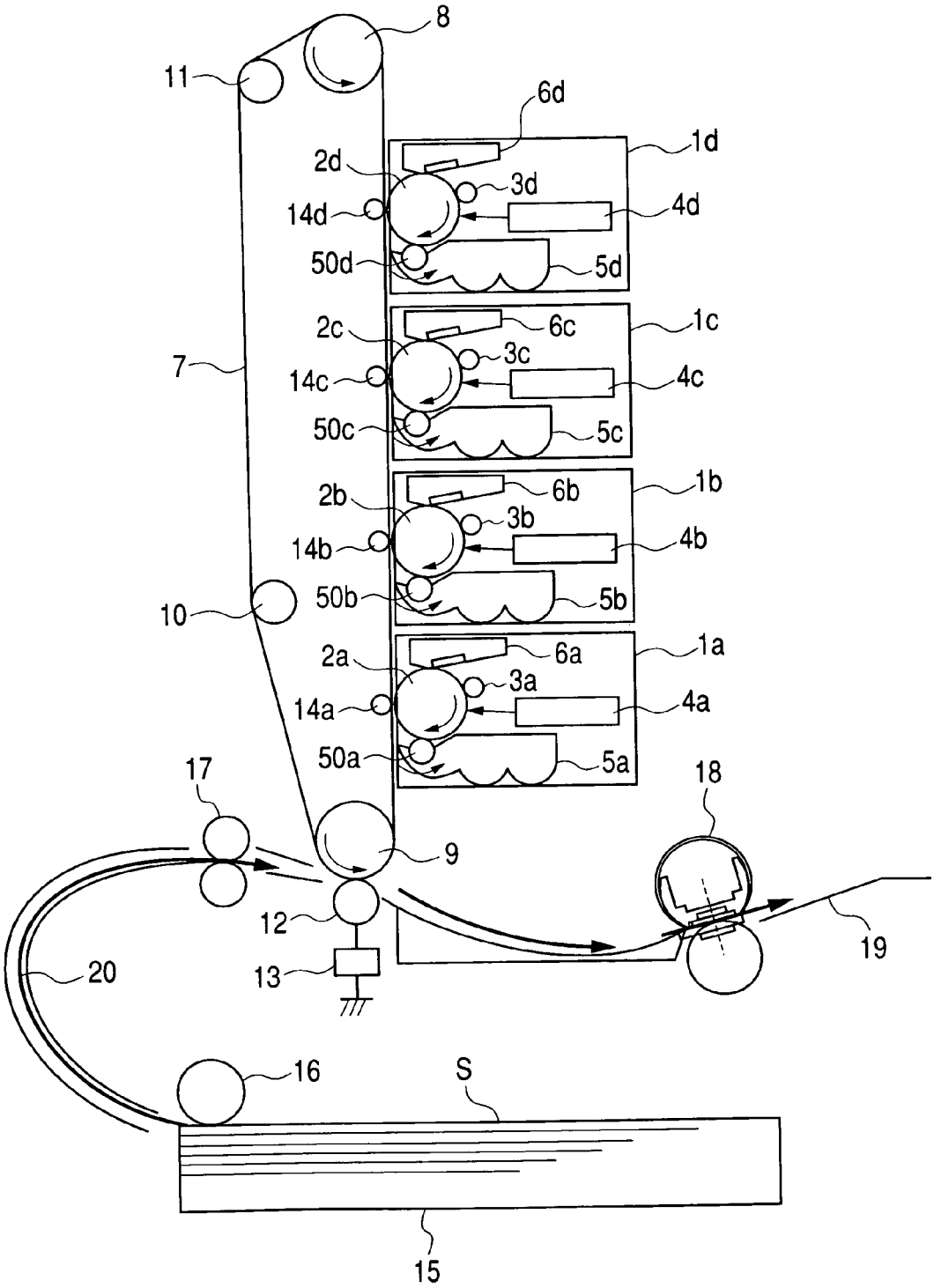
FIG. 1 is a cross-sectional view showing an image forming apparatus equipped with an image heating apparatus of the present invention.
Figure 2A:
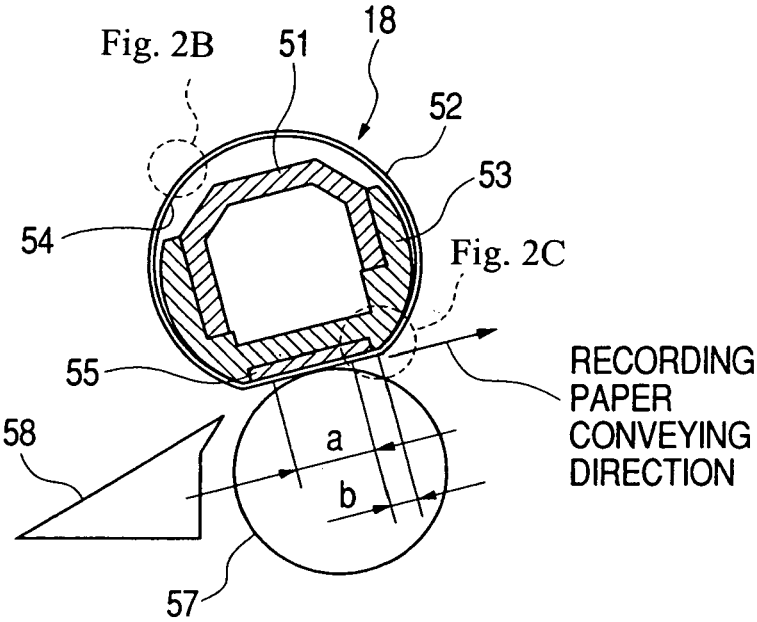
FIG. 2A is a schematic view showing an entire fixing apparatus embodying the present invention.
Figure 2B:
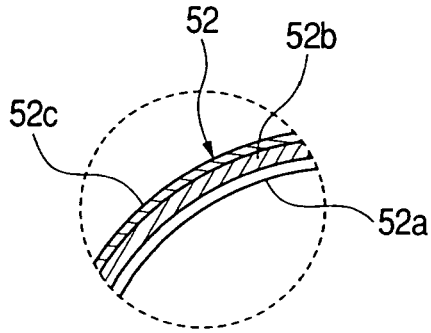
FIG. 2B is a magnified cross-sectional view of a part of a fixing film shown in FIG. 2A.
Figure 2C:
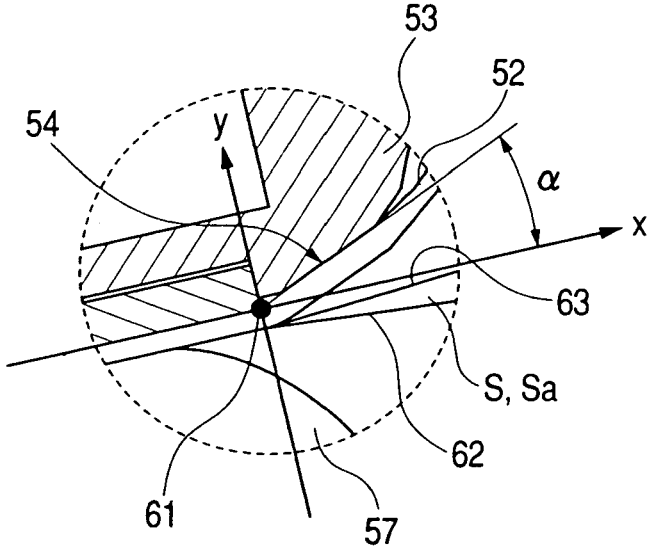
FIG. 2C is a magnified schematic view of a separating portion for a recording medium shown in FIG. 2A.
Figure 4:
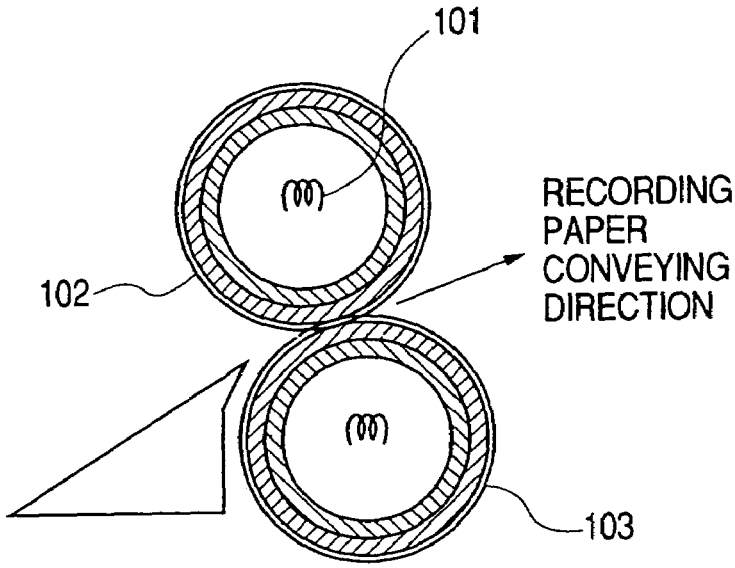
FIG. 4 PRIOR ART
FIG. 4 is a schematic view of a fixing apparatus of a conventional heat roller type.
Figure 5:
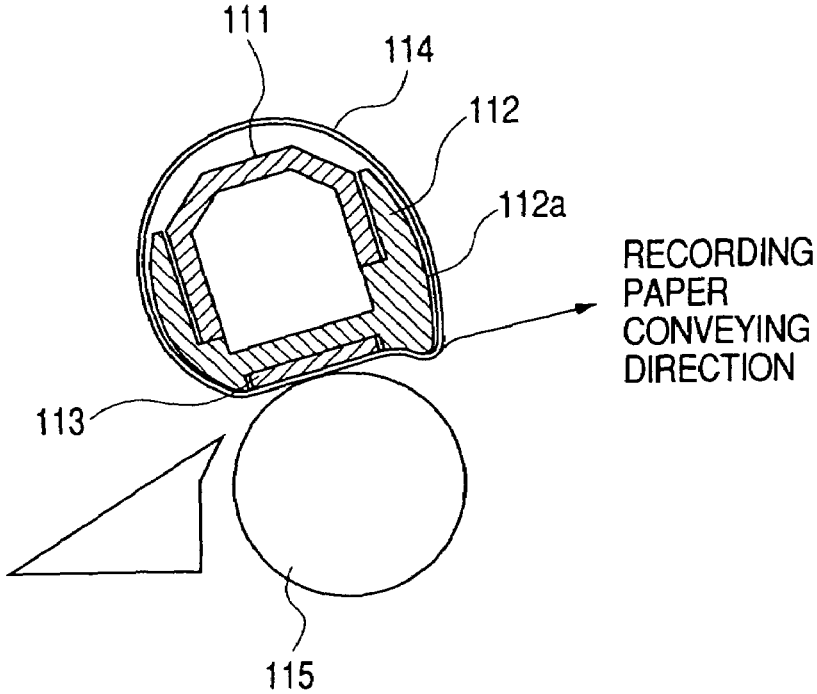
FIG. 5 PRIOR ART
FIG. 5 is a schematic view of a fixing apparatus of a conventional film heating type.
Figure 6:
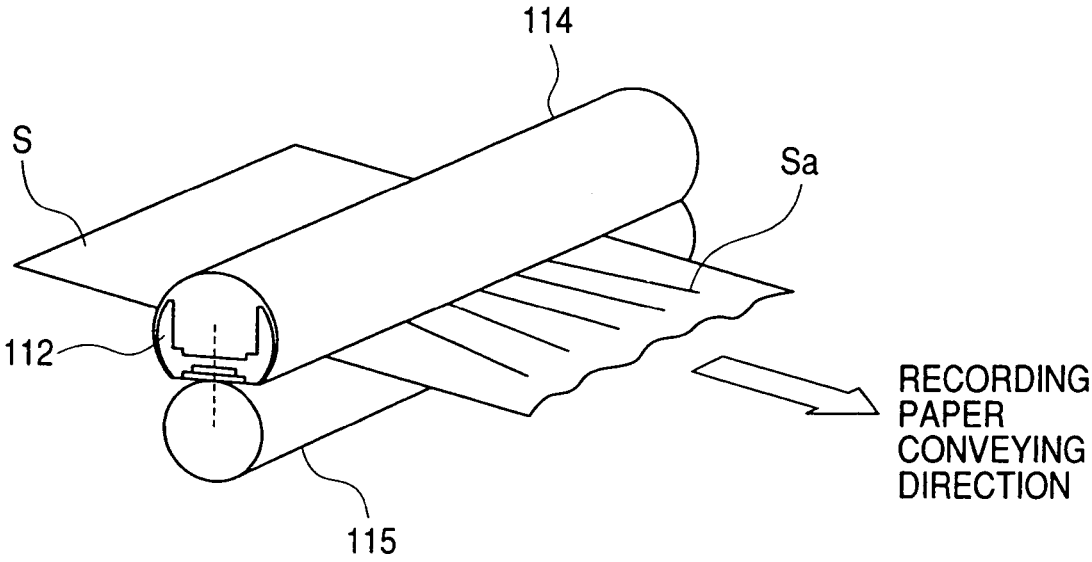
FIG. 6 PRIOR ART
FIG. 6 is a perspective view schematically showing an undulated state of a recording medium.
Figure 7:
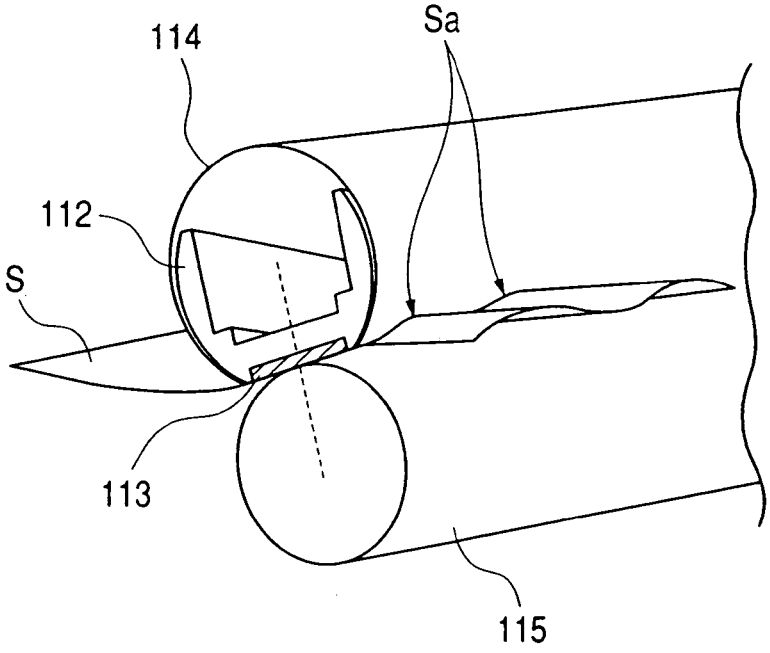
FIG. 7 PRIOR ART
FIG. 7 is a magnified view of FIG. 6.
Figure 8:
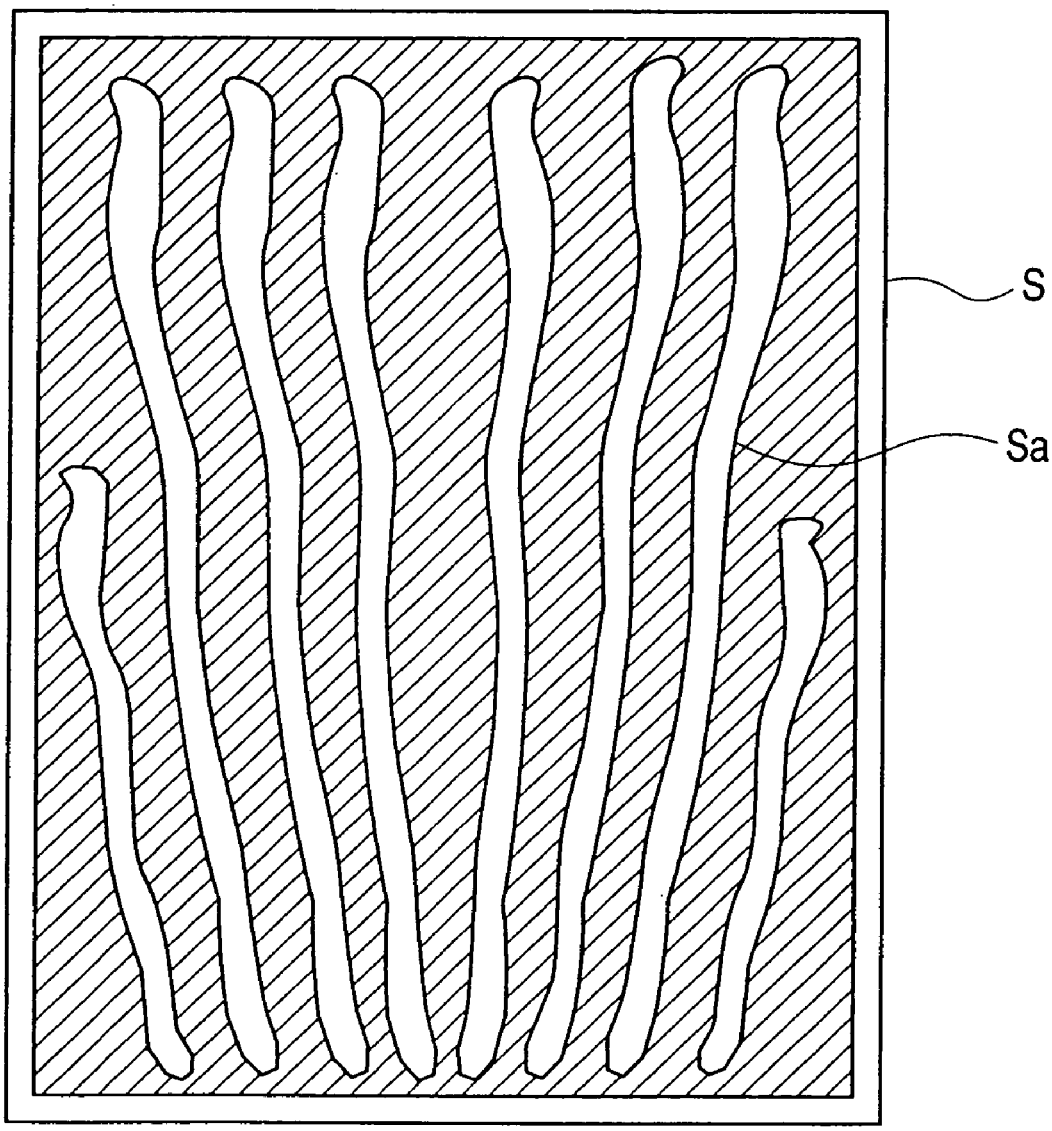
FIG. 8 PRIOR ART
FIG. 8 is a view showing portions of an image defect.

In the following, there will be explained, with reference to accompanying drawings, an embodiment of an image forming apparatus utilizing a fixing apparatus of the present invention. FIG. 1 is a view showing an example of the image forming apparatus, while FIGS. 2A, 2B and 2C are schematic views of a fixing apparatus, and FIG. 3 is a table showing experimental results of an optical transparency, a separability for the recording medium and an endurance of the fixing film as a function of a separation angle $\alpha$. In the following, there will be explained at first an entire configuration of an image forming apparatus and then a configuration of a fixing apparatus.

(Image Forming Apparatus)

The image forming apparatus of the present embodiment is a full-color image forming apparatus employing an electrophotographic process, and is provided with four process stations 1*a* to 1*d* which are arranged substantially linearly in a substantially vertical direction for forming images of respectively yellow, magenta, cyan and black colors, and a conveying path 20 for conveying a sheet S.

The process stations 1*a* to 1*d* are at least provided with photosensitive drums 2*a* to 2*d* for bearing latent images, and, around the photosensitive drums 2*a* to 2*d*, there are arranged charging rollers 3*a* to 3*d* for uniformly charging the photosensitive drum 2*a* to 2*d*, exposure units 4*a* to 4*d* for irradiating the photosensitive drums 2*a* to 2*d* with laser beams thereby forming latent images, developing means 5*a* to 5*d* for developing the latent images formed on the photosensitive drums 2*a* to 2*d* with toners of corresponding colors (magenta, cyan, yellow and black) thereby forming visible images, and cleaning apparatuses 6*a* to 6*d* for removing toners remaining on the photosensitive drums 2*a* to 2*d*.

The developing means 5*a* to 5*d* are provided with developing sleeves 50*a* to 50*d* for carrying the toners. The developing sleeves 50*a* to 50*d* are supported with a predetermined gap to the corresponding photosensitive drums 2*a* to 2*d*, and a developing bias is applied between the photosensitive drums 2*a* to 2*d* and the developing sleeves 50*a* to 50*d*.

An intermediate transfer belt 7 is supported by a driving roller 8, an idler roller 9 and belt supporting rollers 10, 11, and is rotated in a direction indicated by an arrow. The intermediate transfer belt 7 is conveyed along a direction of arrangement of the process stations 1*a* to 1*d*, and toner images of respective colors on the photosensitive drums 2*a* to 2*d* are transferred by the process stations 1*a* to 1*d* in succession onto a surface of the intermediate transfer belt 7 by primary transfer means 14*a* to 14*d*, thereby forming a full-color image.

On the other hand, sheets S are contained and stacked in a feeding cassette 15 provided in a lower part of the apparatus, then are separated and fed one by one by a feed roller 16 from the cassette 15 and fed to a pair of registration rollers 17. The paired registration rollers 17 supply the fed sheet S to a nip between the intermediate transfer belt 7 and a secondary transfer roller 12.

On a lower most surface of the intermediate transfer belt 7, there is contacted the secondary transfer roller 12 which is so positioned as to oppose to the idler roller 9, and the secondary transfer roller 12 pinches and conveys the sheet S as a recording medium, in cooperation with the intermediate transfer belt 7. The secondary transfer roller 12 is given a bias voltage from a high voltage source 13, whereby the toner image on the intermediate transfer belt 7 is secondary transferred onto the sheet S, passing between the secondary transfer roller 12 and the intermediate transfer belt 7, and the sheet is then conveyed to a fixing apparatus 18.

The sheet S bearing the transferred toner image is conveyed to the fixing apparatus 18 serving as an image heating apparatus. In the fixing apparatus 18, the toner image is fixed to the sheet S by heat and pressure. Thus a permanent image is formed on the sheet S, which is then discharged onto a discharge tray 19 provided outside the apparatus.

(Fixing Apparatus)

The fixing apparatus 18 is provided, as shown in FIG. 2A, with a heater 55, a holder 53 for supporting the heater 55, a fixing sleeve (rotary member) 52 of a film shape provided around the holder 53, a reinforcing stay 51 constituted of a rigid member having a downward U-shaped cross section, a pressure roller 57 opposed to the heater 55 across the fixing sleeve 52, and a guide 58. The sheet passing between the pressure roller 57 and the fixing sleeve 52 is pressed in a pressure nip portion a, and remains in close contact with the fixing sleeve 52 in a contact area b thereafter.

The fixing sleeve 52 is constituted, as shown in a magnified view in FIG. 2B, of a metal film (metal layer) 52*a*, an elastic layer 52*b*, and a releasing layer 52*c* from the inside. Also the fixing sleeve 52 has a heat capacity per unit area of about 0.1 $J/cm^2 \cdot K$.

The heater 55 is constituted by forming a heat-generating resistor on an alumina substrate.

The sheet S, immediately after the discharge from the pressure nip portion a in a fixing operation, shows a thermal expansion as it is released from a constriction in the pressure nip portion a. Because of a difference in the expansion rate between a constricted portion in the nip and a released portion after the nip, an undulation Sa in the longitudinal direction is generated in the sheet S as shown in a magnified view in FIG. 2C. In such undulation Sa, a line convex to above is regarded as an upper end portion 63 of undulation, and a line convex to below is regarded as a lower end portion 62. The upper end portion 63 contacting longer with the fixing sleeve 52 tends to receive an excessive heat in comparison with the lower end portion 62, thereby resulting in an image defect as already explained in the conventional example.

Therefore, in the present embodiment, an internal orbit 54 of the fixing sleeve 52 at a downstream area of the nip, constituted of the pressure roller 57, the fixing sleeve 52 and the holder 53, is constructed as follows.

In the description, along a conveying direction of the recording medium S, a side of a supply source is defined as "upstream", and a side of a conveying destination is defined as "downstream". Also in the pressure roller 57 and the fixing sleeve 52, the terms "upstream" and "downstream" are defined in a similar manner.

In a cross-sectional relationship of the pressure roller 57, the fixing sleeve 52 and the heater 55 as shown in FIG. 2C, a downstream end of a surface of the heater 55, in the conveying direction of the recording medium S and opposed to the pressure roller 57, is taken as an original point. Also a direction of an imaginary plane (ideal surface) constituting an extension of the surface of the heater 55 at the side of the pressure nip portion a is taken as an x-axis, and a line perpendicularly crossing the x-axis at the original point is taken as a Y-axis. Also a downstream direction of the x-axis is taken as a positive direction thereof, and a direction toward a side where the fixing sleeve 52 is present, from the original point, is taken as a position direction of the y-axis. Under such definitions, the holder 53 is so shaped that the internal orbit 54 of the fixing sleeve 52 is present in a first quadrant in a coordinate system defined by the x-axis and the y-axis. More specifically, the fixing sleeve 52 is separated from the pressure roller 57 immediately after passing the downstream end of the surface of the heater 55 opposed to the pressure roller 57.

In such configuration, the fixing sleeve 52 does not enter the side of the pressure roller 57 beyond the plane constituted by the heater surface, thereby eliminating a difference in the heat amounts given to the convex portion and the concave portion of an undulation Sa even in case such undulation Sa is generated in the recording medium S, whereby a local deterioration in transparency and a deterioration in glossiness can be prevented. An angle formed by the imaginary plane (ideal surface) constituted by the extension of the surface of the heater 55 at the side of the pressure nip portion a and an imaginary plane passing through the original point and tangential to the internal curved surface of the fixing sleeve 52 is defined as a separation angle $\alpha$.

A larger separation angle a allows to improve the transparency and the glossiness, and to improve a separability between the fixing sleeve 52 and the recording medium S thereby preventing sticking of the recording medium S to the fixing sleeve 52. However, an increase in the separation angle $\alpha$ increases a bending stress in the fixing sleeve 52 at the end portion 61 of the heater 55, thereby gradually deteriorating the endurance of the fixing sleeve 52. For this reason, it is important to select the separation angle $\alpha$ so as to satisfy the transparency, glossiness, separability and endurance. For this reason, an experiment was executed to select such separation angle $\alpha$, and results are shown in FIG. 3.

FIG. 3 shows a table indicating the result of experiment. The table shows the unevenness in the transparency and glossiness of the sheet S, the separability and the endurance as a function of the separation angle $\alpha$. In the table, "○" means "satisfactory", "Δ" means "fair", and "x" means "poor". From this experiment, it is identified possible to realize a state with satisfactory transparency, glossiness and separability without deteriorating the endurance of the fixing sleeve 52 by selecting the separation angle $\alpha$ for the fixing sleeve 52 in a state shown in FIG. 2C, within a range from 10° to 40° at least within a range of $0<x<7$ (mm).

As explained in the foregoing, the present invention allows, in an image heating apparatus provided with a fixing sleeve including at least a metal layer, to provide a fixing apparatus satisfactory in separability and endurance and providing an image uniform in transparency and glossiness, and to execute a fixing operation without sacrificing the image quality even in case of employing a fixing film of a relatively large heat capacity.

The present invention is not limited to the above-described embodiment but is subject to modifications within the technical scope.

What is claimed is:

1. An image heating apparatus for heating an image formed on a recording material, comprising:

a heater;

a holder for holding said heater;

a rotating member rotating around said holder, said rotating member being flexible and having a metal layer; and a pressure roller forming a nip with said heater through said rotating member;

wherein said rotating member rotates in a direction to be apart from said pressure roller with an angle equal to or more than 10 degrees and equal to or less than 40 degrees with regard to an ideal plane extending from the surface of said heater of a side on which said pressure roller exists just after said rotating member passes through a downstream end portion of said heater on the surface of said heater of a side on which said pressure roller exists.

2. An image heating apparatus according to claim 1, wherein said rotating member further comprises an elastic layer.

* * * * *

UNITED STATES PATENT AND TRADEMARK OFFICE

CERTIFICATE OF CORRECTION

PATENT NO. : 7,003,253 B2 
APPLICATION NO. : 10/691497
DATED : February 21, 2006
INVENTOR(S) : Michio Uchida et al.

It is certified that error appears in the above-identified patent and that said Letters Patent is hereby corrected as shown below:

COLUMN 2:
Line 21, "contact longer;" should read --contacts longer--.
Line 23, "an" should be deleted.

COLUMN 4:
Line 25, "lower most" should read --lowermost--.
Line 32, "secondary" should read --secondarily--.

COLUMN 5:
Line 5, "an" should be deleted.

COLUMN 6:
Line 20, "40°" should read --40°,--.

COLUMN 14:
Line 5, "a" should read --α--.

Signed and Sealed this

Fifteenth Day of August, 2006

JON W. DUDAS
*Director of the United States Patent and Trademark Office*